US012383063B2

(12) United States Patent
Cui

(10) Patent No.: US 12,383,063 B2
(45) Date of Patent: Aug. 12, 2025

(54) DECK CHAIR

(71) Applicant: Ningbo Sunmate Home & Casual Promotion Co., Ltd., Zhejiang (CN)

(72) Inventor: Zhongmin Cui, Zhejiang (CN)

(73) Assignee: Ningbo Sunmate Home & Casual Promotion Co., Ltd., Ningbo (CN)

( * ) Notice: Subject to any disclaimer, the term of this patent is extended or adjusted under 35 U.S.C. 154(b) by 225 days.

(21) Appl. No.: 18/460,961

(22) Filed: Sep. 5, 2023

(65) Prior Publication Data

US 2024/0081531 A1 Mar. 14, 2024

(30) Foreign Application Priority Data

Sep. 9, 2022 (CN) ..... 202222406403.9

(51) Int. Cl.

| | |
|---|---|
| ***A47C 1/024*** | (2006.01) |
| ***A47C 1/02*** | (2006.01) |
| ***A47C 1/035*** | (2006.01) |
| ***A47C 1/14*** | (2006.01) |
| ***A47C 3/029*** | (2006.01) |
| ***A47C 7/02*** | (2006.01) |
| ***A47C 7/50*** | (2006.01) |

(52) U.S. Cl.

CPC ..... *A47C 1/02* (2013.01); *A47C 1/024* (2013.01); *A47C 1/035* (2013.01); *A47C 1/14* (2013.01); *A47C 3/029* (2013.01); *A47C 7/5066* (2018.08); *A47C 7/028* (2013.01)

(58) Field of Classification Search

CPC ..... A47C 1/035; A47C 7/028; A47C 7/5066; A47C 1/024

See application file for complete search history.

(56) References Cited

U.S. PATENT DOCUMENTS

| | | | | | |
|---|---|---|---|---|---|
| 444,992 | A * | 1/1891 | Pohl | A47C 3/029 | 297/271.6 X |
| 1,855,130 | A * | 4/1932 | Appleby | A47C 4/16 | 297/31 |
| 1,916,771 | A * | 7/1933 | Parks | A47C 4/16 | 297/31 |
| 2,195,461 | A * | 4/1940 | Koenig | A47C 4/16 | 297/31 X |
| 2,229,154 | A * | 1/1941 | Watling | A47C 4/14 | 297/39 |
| 2,468,491 | A * | 4/1949 | Dorschner | A47C 4/14 | 297/31 |
| 2,490,884 | A * | 12/1949 | Rau | A47C 4/027 | 297/31 X |
| 2,547,897 | A * | 4/1951 | Wozniak | A47C 4/16 | 297/31 |

(Continued)

*Primary Examiner* — Rodney B White

(74) *Attorney, Agent, or Firm* — Wang Law Firm, Inc.

(57) ABSTRACT

A deck chair with a seat has two opposite sides and two handrails, each handrail being arranged on one of the two opposite sides of the seat; a back arranged behind the seat and located between the two handrails; a footrest arranged in front of the seat and lower than a height of the seat; wherein, the back is rotatable relative to the seat, and the footrest is movable and is capable of extending back and forth relative to the seat. Various sitting postures and lying postures can be realized by adjusting the footrest and the back, thereby satisfying various needs and greatly expanding applicability.

6 Claims, 7 Drawing Sheets

(56) References Cited

U.S. PATENT DOCUMENTS

| | | | | | |
|---|---|---|---|---|---|
| 2,650,652 | A * | 9/1953 | Watson | A47C 4/14 | 297/31 |
| 4,389,070 | A * | 6/1983 | Chien | A47C 7/506 | 297/423.26 |
| 5,120,071 | A * | 6/1992 | Thibault | A47C 7/006 | 297/423.21 X |
| 5,275,454 | A * | 1/1994 | Deardorff | A47C 5/02 | 297/271.6 X |
| 5,911,469 | A * | 6/1999 | Young | A47C 7/54 | 297/31 X |
| 7,401,854 | B2 * | 7/2008 | Adams | A47C 3/04 | 297/239 X |
| 8,104,141 | B2 * | 1/2012 | Yamashita | A47C 1/026 | 16/334 |
| 8,814,261 | B2 * | 8/2014 | Chamberlain | A47C 4/52 | 297/31 X |
| 12,004,655 | B2 * | 6/2024 | Goodworth | A47C 5/12 | |
| 2005/0200167 | A1 * | 9/2005 | Bollenbach | A47C 1/14 | 297/181 |
| 2022/0183466 | A1 * | 6/2022 | Lu | A47C 7/5066 | |

* cited by examiner

DECK CHAIR

TECHNICAL FIELD OF THE INVENTION

The present invention relates to a field of chairs, and in particular to a deck chair allowed for sitting and lying.

BACKGROUND OF THE INVENTION

As a kind of common chairs for allowing human beings to sit and lie for rest, deck chairs can be used in rooms, balconies or seaside resorts. In addition, with the increasing applicability of deck chairs, the deck chairs have increasing use functions. For example, a Chinese Patent CN210169452U (patent NO: ZL201921096882.0) disclosed a sun-shading multifunctional foldable deck chair which is convenient to store. And a Chinese Patent CN212574527U (patent NO: ZL202021491329.X) disclosed a foldable deck chair.

When in use of the present deck chairs, the adjustment of the positions and angles of the back and the seat is limited, so it is difficult to give consideration to body comfort when users are sitting or lying, thus affecting the applicability of the deck chairs.

SUMMARY OF THE INVENTION

It is an object of the present invention to provide a deck chair which gives consideration to body comfort when users are sitting or lying.

For achieving the above object, the deck chair comprises a seat having two opposite sides; two handrails, each handrail being arranged on one of the two opposite sides of the seat; a back arranged behind the seat and located between the two handrails; a footrest arranged in front of the seat and lower than a height of the seat; wherein, the back is rotatable relative to the seat, and the footrest is movable and is capable of extending back and forth relative to the seat.

Preferably, the deck chair is configured to assume at least the following three positions:

- when the deck chair is in a first position, the back has a first angle relative to the seat, and the footrest is in a near position to the seat;
- when the deck chair is in a second position, the back is tilted backward to a second angle relative to the seat, and the footrest extends outward away from the seat;
- when the deck chair is in a third position, the back is tilted backward from the second position to a third angle relative to the seat, and the footrest extends outward away from the seat;
- the second angle is greater than the first angle, and the third angle is greater than the second angle.

Preferably, an angle adjustment mechanism is disposed between the seat and the back, and the angle adjustment mechanism comprising:

- a first connecting member having two ends;
- a second connecting member having two ends;
- a bolt;
- a pressure plate;
- one end of the first connecting member is connected to the seat and another end of the first connecting member has an accommodating chamber;
- one end of the second connecting member is connected to the back and another end of the second connecting member forms a rotating portion, a periphery of the rotating portion has ratchet teeth which are rotatably arranged in the accommodating chamber of the first connecting member by a rotating shaft passing through a hole in the rotating portion of the second connecting member;
- the bolt is elastically arranged in the accommodating chamber of the first connecting member and cooperates with the ratchet teeth to limit the second connecting member;
- the pressure plate is arranged in the rotating portion of the second connecting member and rotates with the rotating portion, when the pressure plate is in a rotating state, the pressure plate resists against the bolt so that the bolt releases the ratchet teeth.

The pressure plate has an end portion, and the pressure plate releases resistance against the bolt after the end portion passes over the bolt, so that the back can be opened to a maximum angle.

Preferably, the bolt is rotatably arranged in the accommodating chamber of the first connecting member through a shaft pin, and a torsion spring is sleeved on the shaft pin so that the locking tongue is elastic.

Preferably, two arc-shaped support bars are arranged beneath the seat. The support bars can make the deck chair swing back and forth, thereby improving the body comfort.

Preferably, the footrest is connected to each support bar through two connecting rod mechanisms, each connecting rod mechanism comprising:

- a connecting sheet having a front end and a rear end;
- a first connecting rod having a bottom end and a top end;
- a guide sheet arranged at a rear end of a bottom of the footrest and having a guide slot;
- a second connecting rod having a bottom end and a top end;
- the connecting sheet is arranged on one side of the support bar, the bottom end of the first connecting rod is movably connected to the front end of the connecting sheet, and the top end of the first connecting rod is movably connected to the footrest;
- the bottom end of the second connecting rod is movably connected to the rear end of the connecting sheet, and the top end of the second connecting rod is arranged in the guide slot of the guide sheet.

Compared with the prior art, the deck chair of the present invention has the following advantages. When in usage, various sitting postures and lying postures can be realized by adjusting the footrest and the back, thereby satisfying various needs and greatly expanding the applicability.

DETAILED DESCRIPTION OF THE INVENTION

The present invention will be further described below in details by embodiments with reference to the accompanying drawings.

Figure 1:
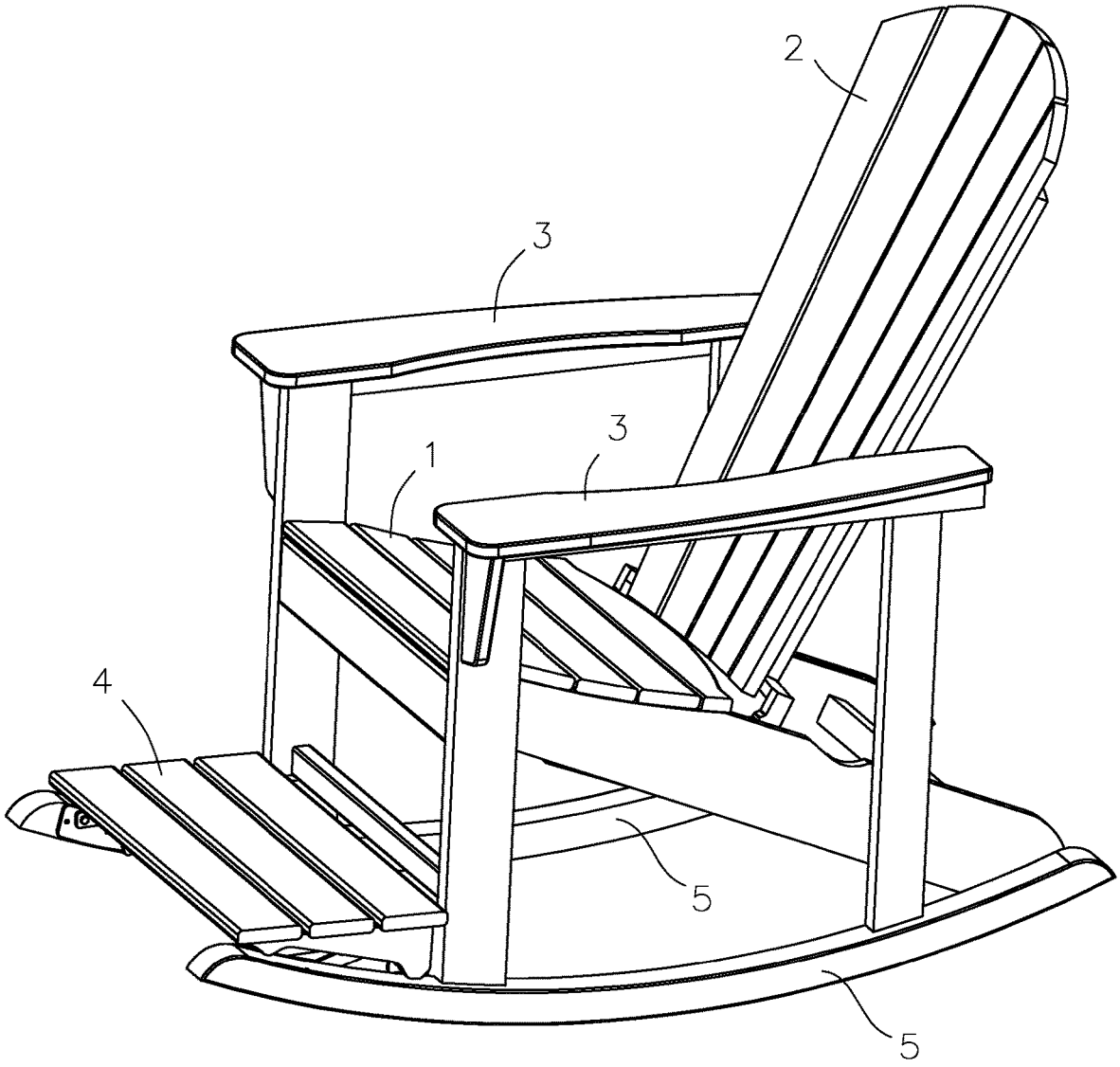
FIG. 1 is a perspective view of a deck chair when in the first state according to an embodiment of the present invention.
Figure 2:
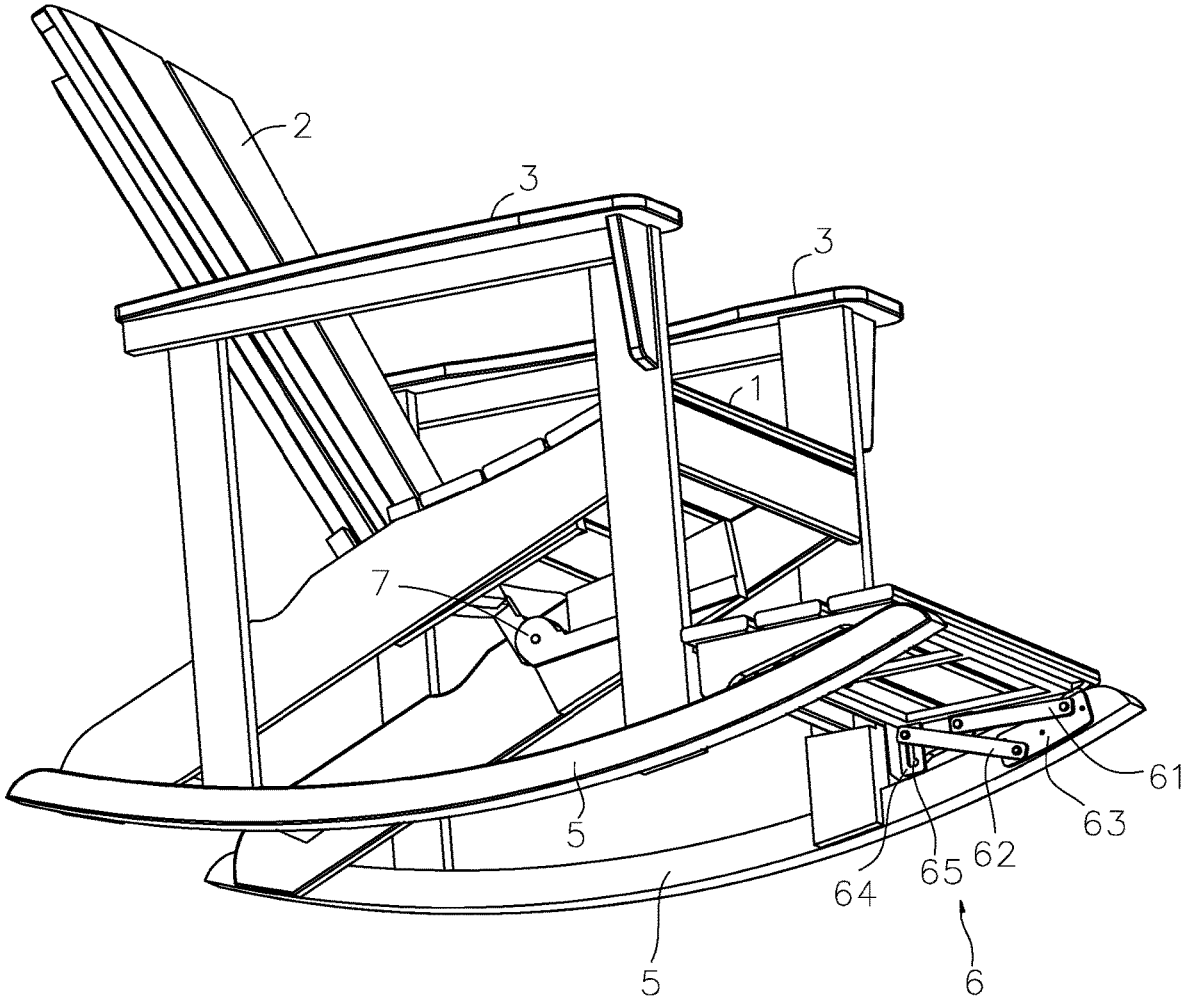
FIG. 2 is another perspective view of the FIG. 1.

As shown in FIG. 1 and FIG. 2, the deck chair of the embodiment of the present invention comprises a seat 1 having two opposite sides, two handrails 3, a back 2 arranged behind the seat 1 and located between the two handrails 3, a footrest 4 arranged in front of the seat 1 and lower than a height of the seat 1 and two arc-shaped support bars 5 arranged beneath the seat 1. Each handrail 3 is arranged on one of the two opposite sides of the seat 1. The back 2 is rotatable relative to the seat 1, and the footrest 4 is movable and is capable of extending back and forth relative to the seat 1.

Figure 5:
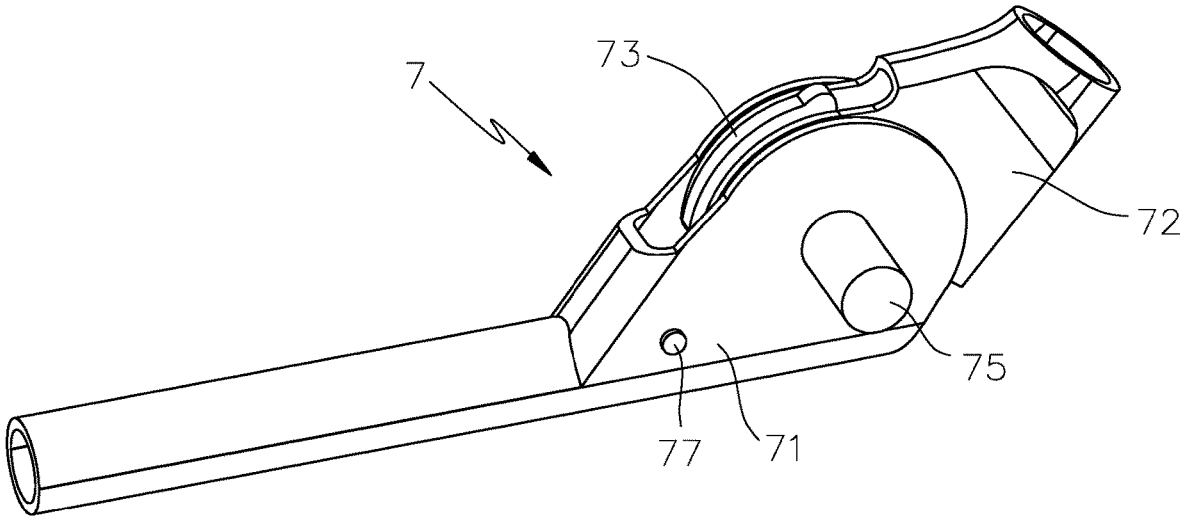
FIG. 5 is a perspective view of an angle adjustment mechanism according to the embodiment of the present invention.
Figure 6:
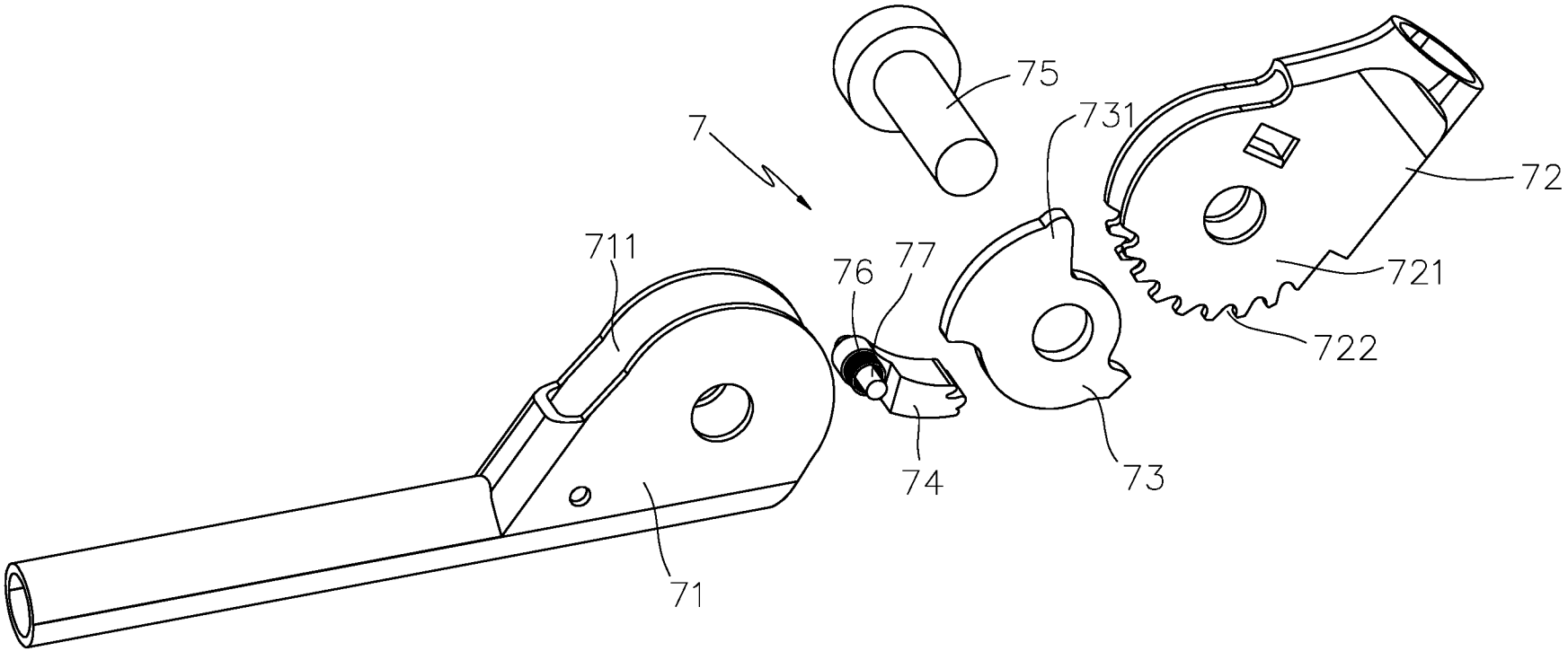
FIG. 6 is an exploded view of the FIG. 5.

As shown in FIG. 5 and FIG. 6, an angle adjustment mechanism 7 is disposed between the seat 1 and the back 2, and the angle adjustment mechanism 7 comprises a first connecting member 71, a second connecting member 72, a bolt 74 and a pressure plate 73.

One end of the first connecting member 71 is connected to the seat 1 and another end of the first connecting member 71 has an accommodating chamber 711; one end of the second connecting member 72 is connected to the back 2 and another end of the second connecting member 72 forms a rotating portion 721; a periphery of the rotating portion 721 has ratchet teeth 722 which are rotatably arranged in the accommodating chamber 711 of the first connecting member 71 by a rotating shaft 75 passing through a hole in the rotating portion 721 of the second connecting member 72.

The bolt 74 is elastically arranged in the accommodating chamber 711 of the first connecting member 71 and cooperates with the ratchet teeth 722 to limit the second connecting member 72; the bolt 74 is rotatably arranged in the accommodating chamber 711 of the first connecting member 71 through a shaft pin 77, a torsion spring 76 is sleeved on the shaft pin 77 so that the bolt 74 is elastic.

The pressure plate 73 is arranged in the rotating portion 721 of the second connecting member 72 and rotates with the rotating portion 721, when the pressure plate 73 is in a rotating state, the pressure plate 73 resists against the bolt 74 so that the bolt 74 releases the ratchet teeth 722.

The pressure plate 73 has an end portion 731, and the pressure plate 73 releases resistance against the bolt 74 after the end portion 731 passes over the bolt 74. Thus, the back can be opened to the maximum angle.

In an initial state, the bolt 74 cooperates with the ratchet teeth 722, and the first connecting member 71 and the second connecting member 72 are connected and positioned, so that the angle between the back 2 and the seat 1 is fixed. When it is necessary to adjust the back 2 and the seat 1 to a reduced angle, the back 2 is tilted forward, the back 2 drives the second connecting member 72 and the pressure plate 3 to rotate, and the pressure plate 3 resists against the bolt 74 so that the bolt releases the ratchet teeth 722. After it is adjusted to a certain angle, the back 2 is released, and the bolt 74 is reset under the action of the torsion spring to block the ratchet teeth 722.

When it is necessary to adjust the back 2 and the seat 1 to an increased angle, after the tail end of the pressure plate 3 passes over the bolt 74, the angle between the back 2 and the seat 1 can be adjusted to maximum and then adjusted to an appropriate angle according to the operation of reducing the angle described before.

Figure 4:
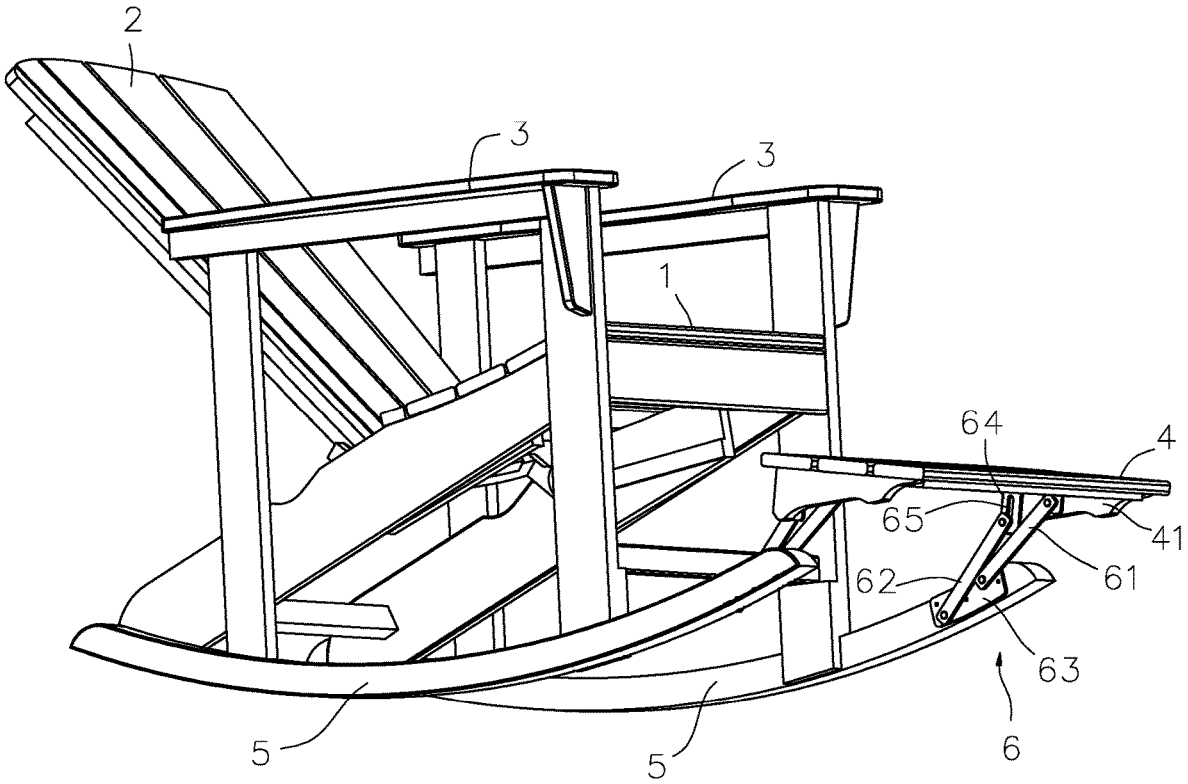
FIG. 4 is another perspective view of the FIG. 3.

As shown in FIG. 2 and FIG. 4, the footrest 4 according to the embodiment of the present invention is connected to each support bar 5 through two connecting rod mechanisms 6, each connecting rod mechanism 6 comprises a connecting sheet 63, a first connecting rod 61, a guide sheet 64 and a second connecting rod 62. The connecting sheet 63 is arranged on one side of the support bar 5. The bottom end of the first connecting rod 61 is movably connected to the front end of the connecting sheet 63 and the top end of the first connecting rod 61 is movably connected to the footrest 4. The guide plate 64 is arranged at the rear end of the side plate 41 on the bottom of the footrest 4 and has a guide slot 65. The bottom end of the second connecting rod 62 is movably connected to the rear end of the connecting sheet 63, and the top end of the second connecting rod 62 is arranged in the guide slot 65 of the guide sheet 64.

The deck chair can be configured to assume at least the following three positions.

As shown in FIG. 1 and FIG. 2, when the deck chair is in a first position, the back 2 has a first angle relative to the seat 1, and the footrest 4 is in a near position to the seat 1. At this time, the chair is suitable for sitting.

Figure 3:
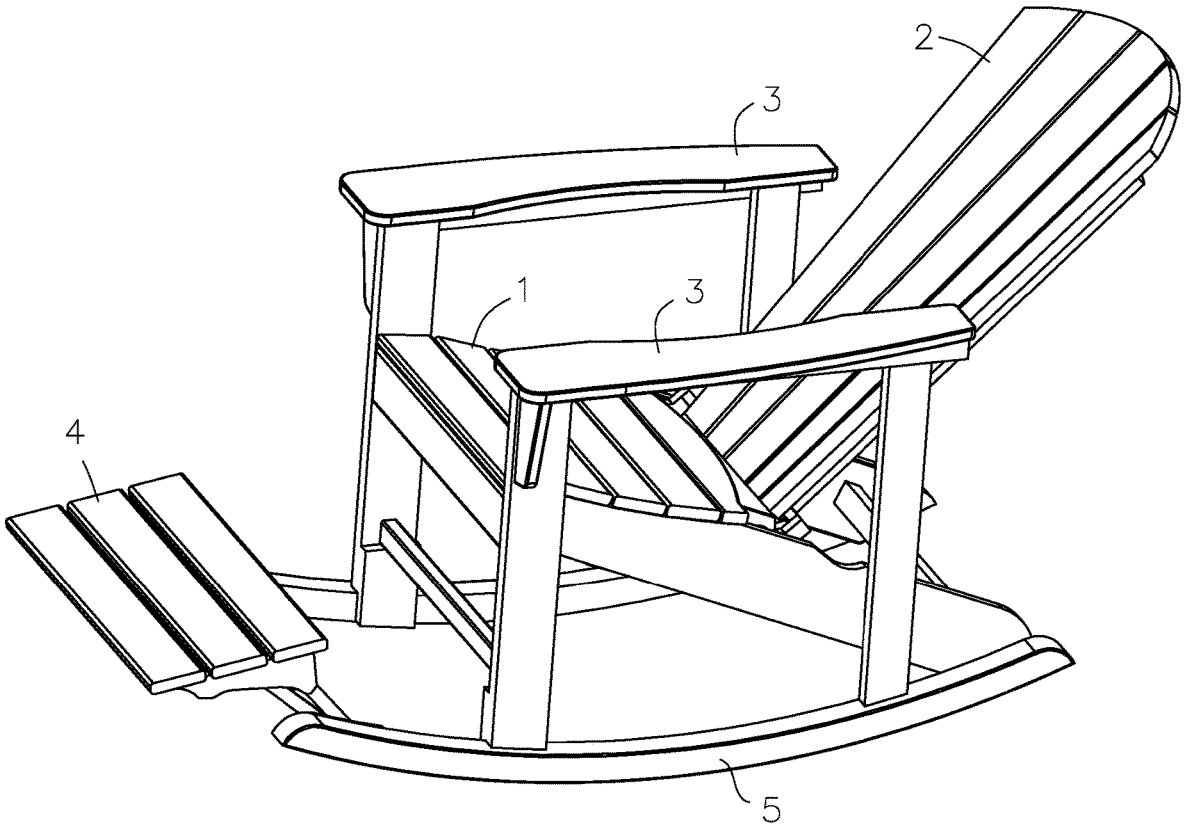
FIG. 3 is a perspective view of the deck chair when in the second state according to the embodiment of the present invention.

As shown in FIG. 3 and FIG. 4, when the deck chair is in a second position, the back 2 is tilted backward to a second angle relative to the seat 1, and the footrest 4 extends outward away from the seat 1. At this time, the chair is suitable for both lying and sitting.

Figure 7:
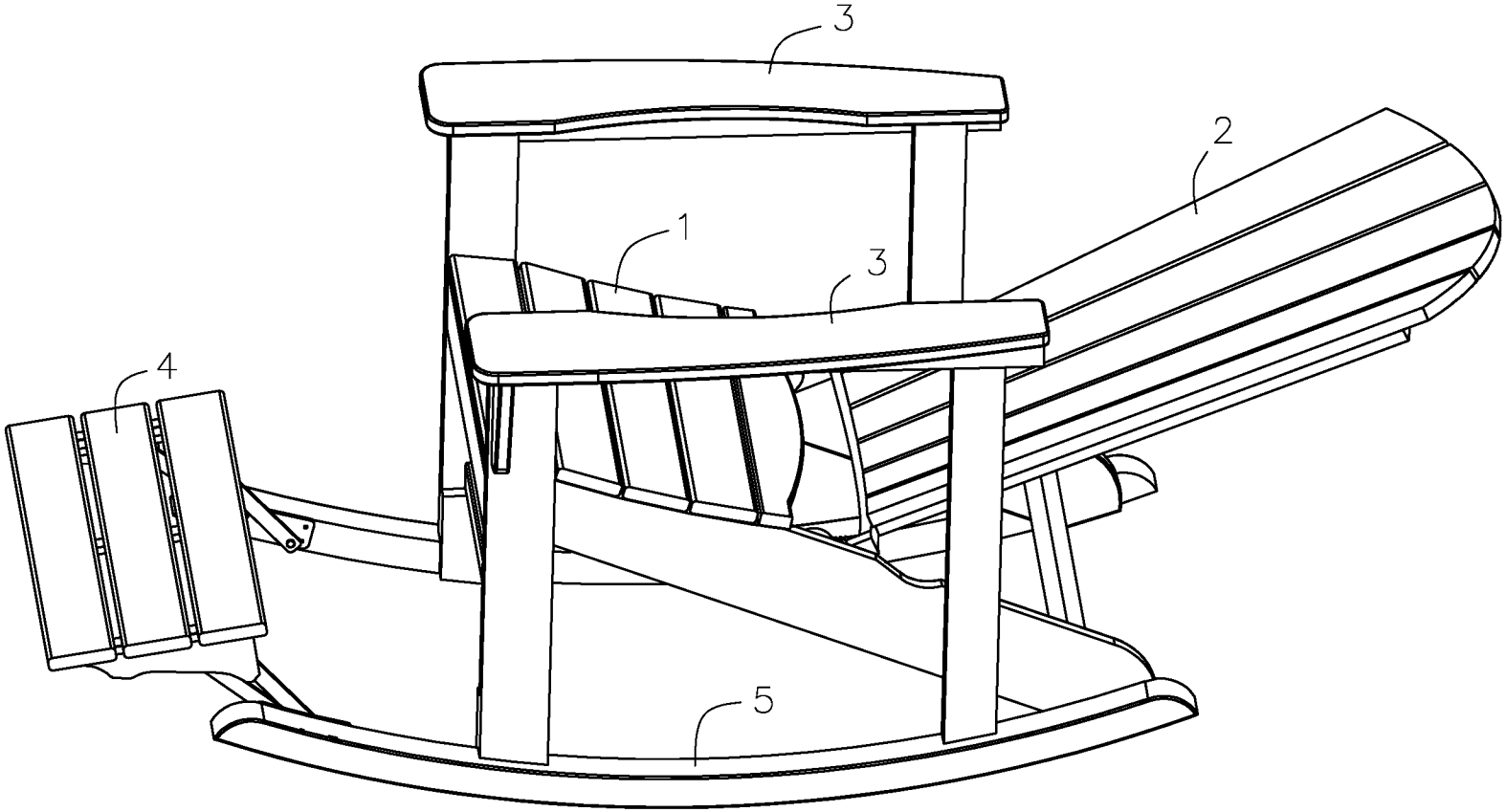
FIG. 7 is a perspective view of the deck chair when in the third state according to the embodiment of the present invention.

As shown in FIG. 7, when the deck chair is in a third position, the back 2 is tilted backward from the second position to a third angle relative to the seat 1, and the footrest 4 extends outward away from the seat 1. At this time, the chair is suitable for lying.

In the embodiment, the second angle is greater than the first angle, and the third angle is greater than the second angle and the first angle.

The invention claimed is:

1. A deck chair, comprising:

a seat having two opposite sides;

two handrails, each handrail being arranged on one of the two opposite sides of the seat;

a back arranged behind the seat and located between the two handrails;

a footrest arranged in front of the seat and lower than a height of the seat;

wherein, the back is rotatable relative to the seat, and the footrest is movable and is capable of extending back and forth relative to the seat;

an angle adjustment mechanism is disposed between the seat and the back, and the angle adjustment mechanism comprises:

a first connecting member having two ends;

a second connecting member having two ends;

a bolt; and a pressure plate;

one end of the first connecting member is connected to the seat and another end of the first connecting member has an accommodating chamber;

one end of the second connecting member is connected to the back and another end of the second connecting member forms a rotating portion, a periphery of the rotating portion has ratchet teeth which are rotatably arranged in the accommodating chamber of the first connecting member by a rotating shaft passing through a hole in the rotating portion of the second connecting member;

the bolt is elastically arranged in the accommodating chamber of the first connecting member and cooperates with the ratchet teeth to limit the second connecting member;

the pressure plate is arranged in the rotating portion of the second connecting member and rotates with the rotating portion, when the pressure plate is in a rotating state, the pressure plate resists against the bolt so that the bolt releases the ratchet teeth.

2. The deck chair of claim 1, wherein the deck chair is configured to assume at least the following three positions:

when the deck chair is in a first position, the back has a first angle relative to the seat, and the footrest is in a near position to the seat;

when the deck chair is in a second position, the back is tilted backward to a second angle relative to the seat, and the footrest extends outward away from the seat;

when the deck chair is in a third position, the back is tilted backward from the second position to a third angle relative to the seat, and the footrest extends outward away from the seat;

the second angle is greater than the first angle, and the third angle is greater than the second angle.

3. The deck chair of claim 1, wherein the pressure plate has an end portion, and the pressure plate releases resistance against the bolt after the end portion passes over the bolt.

4. The deck chair of claim 1, wherein the bolt is rotatably arranged in the accommodating chamber of the first connecting member through a shaft pin, a torsion spring is sleeved on the shaft pin so that the bolt is elastic.

5. The deck chair of claim 1, wherein two arc-shaped support bars are arranged beneath the seat.

6. The deck chair of claim 5, wherein the footrest is connected to each support bar through two connecting rod mechanisms, each connecting rod mechanism comprising:

a connecting sheet having a front end and a rear end;

a first connecting rod having a bottom end and a top end;

a guide sheet arranged at a rear end of a bottom of the footrest and having a guide slot;

a second connecting rod having a bottom end and a top end;

the connecting sheet is arranged on one side of the support bar, the bottom end of the first connecting rod is movably connected to the front end of the connecting sheet, and the top end of the first connecting rod is movably connected to the footrest;

the bottom end of the second connecting rod is movably connected to the rear end of the connecting sheet, and the top end of the second connecting rod is arranged in the guide slot of the guide sheet.

* * * * *